US006287083B1

(12) United States Patent
Hase et al.

(10) Patent No.: US 6,287,083 B1
(45) Date of Patent: Sep. 11, 2001

(54) COMPRESSED AIR PRODUCTION FACILITY

(75) Inventors: Masakazu Hase; Masakazu Aoki, both of Shimizu; Hiroyuki Matsuda, Yaizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/526,564

(22) Filed: Mar. 16, 2000

(30) Foreign Application Priority Data

Apr. 14, 1999 (JP) ..... 11-106223

(51) Int. Cl.[7] ..... F04B 49/00
(52) U.S. Cl. ..... 417/216; 417/2; 417/7
(58) Field of Search ..... 417/212, 213, 417/216, 1, 2–7, 22, 42, 43, 44.2, 286

(56) References Cited

U.S. PATENT DOCUMENTS 4,580,947 * 4/1986 Shibata et al. ..... 417/8
5,743,714 * 4/1998 Drob ..... 417/2
5,797,729 * 8/1998 Rafuse, Jr. et al. ..... 417/3

OTHER PUBLICATIONS

Japanese Patent Unexamined Publication No. 55–164792 Dec. 22, 1980.
Japanese Patent Unexamined Publication No. 7–293477 Nov. 7, 1995.
Japanese Patent Unexamined Publication No. 9–250485 Sep. 22, 1997.
U.S.Patent No. 4815950 Suzuki; Mar. 1989.
U.S.Patent No. 5358387 Aoki; Oct. 1994.

* cited by examiner

*Primary Examiner*—Teresa Walberg
*Assistant Examiner*—Thor Campbell
(74) *Attorney, Agent, or Firm*—Antonelli, Terry, Stout & Kraus, LLP

(57) ABSTRACT

A compressed air production facility includes at least one variable speed compressor and a plurality of constant speed compressor, which are connected in parallel with one another. The variable speed compressor and the plurality of constant speed compressors are capacitively controlled with the use of a pressure in an air reservoir into which discharge air from these compressor are led. Both upper limit pressure at which the variable speed compressor is turned into its load operation mode into its unload operation mode and a lower limit pressure at which the variable speed compressor is turned into its unload operation mode into its load operation mode are set between an upper limit change-over pressure at which all of the plurality of constant speed compressors are turned into their load operation into their unload operation and a lower limit change-over pressure at which all of the plurality of constant speed compressors are changed over from their unload operation into their load operation. With this arrangement, it is possible to provide a power consumption characteristic which is substantially proportional to an air consumption.

16 Claims, 6 Drawing Sheets

COMPRESSED AIR PRODUCTION FACILITY

BACKGROUND OF THE INVENTION

The present invention relates to a compressed air production facility for compressing gas such as air, and in particular, to a compressed air production facility in which a variable speed compressor adapted to change its rotational speed so as to adjust its capacity, and a constant speed compressor are operated in parallel.

For example, a compressed air production facility which is capacitively controlled, is disclosed in Japanese Laid-Open Patent No. H9-250485. The compressor disclosed in this document is provided in its compressed air outlet port with a pressure sensor which detects a discharge pressure. With this arrangement, PID control is carried out for the rotational speed of the compressor with the use of the thus detected discharge pressure in order to capacitively control the compressor.

Conventionally, in such an arrangement that a plurality of compressors which are connected with one another in parallel, are operated, load pressures (start pressures) and unload pressures (rest pressures) of the compressors are set to be different from one another bit by bit. In this case, a change in power consumption (%) with respect to an air consumption (%) by a compressor is such that the power consumption is linearly decreased, as the air consumption is decreased, in either a suction throttling system (S1) or a combination system (S2) in which a system for repeating load operation and unload operation by reducing the discharge pressure is combined with a suction throttling system. However, about 30% (in the case of the system S1) or 70% (in the case of the system S2) of the rated power is consumed even though the air consumption becomes zero.

If a plurality, for example, two, of compressors having the above-mentioned characteristic are automatically operated in parallel and stopped, characteristics S1, S2 shown in FIG. 2, are exhibited. As clearly understood from this figure, the operation of two compressors having volumes which are substantially equal to each other is advantageous in view of power saving in comparison with operation of a single compressor having a discharge air volume which is twice as large as that of the former two compressors.

On the contrary, in a system (R1) using the above-mentioned variable speed compressor disclosed in the above-mentioned Japanese Laid-Open Patent No. H9-250485, a power consumption (%) with respect to an air consumption (%) has a characteristic which is substantially exhibited by a direct proportional curve, but is deviated slightly therefrom if the air consumption is excessively low. Further, if the air consumption becomes zero, the power consumption is lowered to about 10% of its rated power. Accordingly, in the case of operation of two compressors each having this characteristic in parallel, a characteristic R1 shown in FIG. 2 can be obtained, which is excellent in power saving in comparison with those of the systems S1, S2. Although the variable speed compressor has this advantageous characteristic, a variable speed mechanism such as an inverter is required so as to cause such a disadvantage that the costs of the facility becomes higher.

BRIEF SUMMARY OF THE INVENTION

The present invention is devised in view of the disadvantages inherent to the above-mentioned prior art, and accordingly, an object of the present invention is to reduce the power consumption during parallel operation of a plurality of compressors.

To the end, according to the first aspect of the present invention, there is provided a compressed air production facility comprising at least one constant speed compressor which repeats load operation and unload operation under on-off control, a variable speed compressor driven by a motor incorporating an inverter, and a common pipe line or an air reservoir into which discharge air is led from both constant speed compressor and variable speed compressor, detecting means provided in the common pipe line or the air reservoir, for detecting a discharge pressure of the discharge air, and control means for controlling the discharge pressure to a set pressure with the use of the variable speed compressor, wherein the control means controls the discharge pressure of the variable speed compressor during operation to a set pressure between a discharge pressure of the constant speed compressor during load operation and a discharge pressure of the same during unload operation.

With this first aspect of the present invention, when the consumption of the compressed air is deceased, the variable speed compressor is driven through unload operation at a lower limit speed, and then, if this unload operation continues for a predetermined time, it is desired to stop the operation of the variable speed compressor. Further, if the consumption of the compressed air is decreased, it is desired that the unload operation and load operation are repeated for the variable speed compressor at the lower limit speed, and further, the discharge pressure of the variable speed compressor during load operation and the discharge pressure of the same during unload operation are both controlled to fall in a range between the discharge pressure of the constant speed compressor during load operation and the discharge pressure of the same during unload operation. Further a plurality of constant speed compressors are connected to one another in parallel.

Further, it is desirable that both set pressure at which the variable speed compressor is changed over from the load operation into the unload operation, and set pressure at which the variable speed compressor is changed over from the unload operation into the load operation are controlled so as to allow both set pressures to fall between a set pressure at which all constant speed compressors are changed over from the load operation into the unload operation and a set pressure at which all constant speed compressors are changed over from the unload operation into the load operation. More preferably, set pressures at which the constant speed compressors are changed over from the load operation into the unload operations and set pressures with which the same are changed over from the unload operation into the load operation are made to be different from one another, respectively.

Moreover, there may be provided input means for inputting a set pressure for the variable speed compressor, and setting means for setting the discharge pressure or start pressure of the variable speed compressor during the load operation to a value which is lower than the set pressure, and setting the discharge pressure or the rest pressure during the unload operation to a value which is higher than the set pressure.

Further, the constant speed compressor and the variable speed compressor may be provided thereto with automatic setting means so that their set pressures are automatically set to be between the discharge pressure or start pressure during the load operation and the discharge pressure or rest pressure of the same during the unload operation.

Further, the constant speed compressor and the variable speed compressor may be provided with means for automatically stopping the operation of them if the unload operation continues exceeding a preset unload time. In this arrangement, the set unload time of the variable speed compressor may be set to be longer than the set unload time of the constant speed.

In order to achieve the above-mentioned objects, according to the second aspect of the present invention, in the above-mentioned air production facility, the control means controls the discharge pressure of the variable speed compressor to a set pressure between the discharge pressure of the constant speed compressor during the load operation and the discharge pressure of the same during the unload operation, and there is provided pressure detecting means for detecting the discharge pressure, a storage means for storing a pressure at which the discharge pressure changes from its increasing direction into its decreasing direction when the air consumption is decreased, as an unload operation pressure or a rest pressure of the constant speed compressor, and a pressure at which the discharge pressure changes from its decreasing direction into its increasing direction, as a load operation pressure or a rest pressure of the constant speed compressor, and a setting means for setting the set pressure of the variable speed compressor to a value between the thus stored two pressures, wherein a pressure detected by the pressure detecting means is compared with the set pressure of the variable speed compressor, and it is preferable to set the unload operation pressure or rest pressure of the constant speed compressor to a value which is higher than the set pressure of the variable speed compressor and to set the load operation pressure or start pressure of the constant speed compressor to a value which is lower than the set pressure of the same.

To achieve the above-mentioned objects, according to a third aspect of the present invention, there is provided a compressed air production facility comprising a plurality of constant speed compressors which are subjected to on-off control so as to repeat load operation and unload operation at a predetermined speed, a variable speed compressor driven by a motor incorporating an inverter, a common pipe line through which discharge air is led from the compressors, and control means for carrying out such a control that the plurality of constant speed compressors are successively operated or rested in accordance with an air consumption, but the variable speed is always operated.

Further, it is preferable to set a load operation pressure and an unload operation pressure of the variable speed compressor between the load operation starting pressures and the unload operation starting pressures of all the constant speed compressors. Further, the variable speed compressor may be provided with a suction throttle valve, and accordingly, the control means changes over the operation mode between an operation mode in which the speed of the motor for driving this compressor is changed, and an I type unload operation mode or a U-type unload operation mode in which the speed of the motor is held at a lower limit speed under speed control while the suction throttle valve is used.

DETAILED DESCRIPTION OF THE INVENTION

Explanation will be hereinbelow made of embodiments of the present invention with reference to the drawings.

Figure 1:
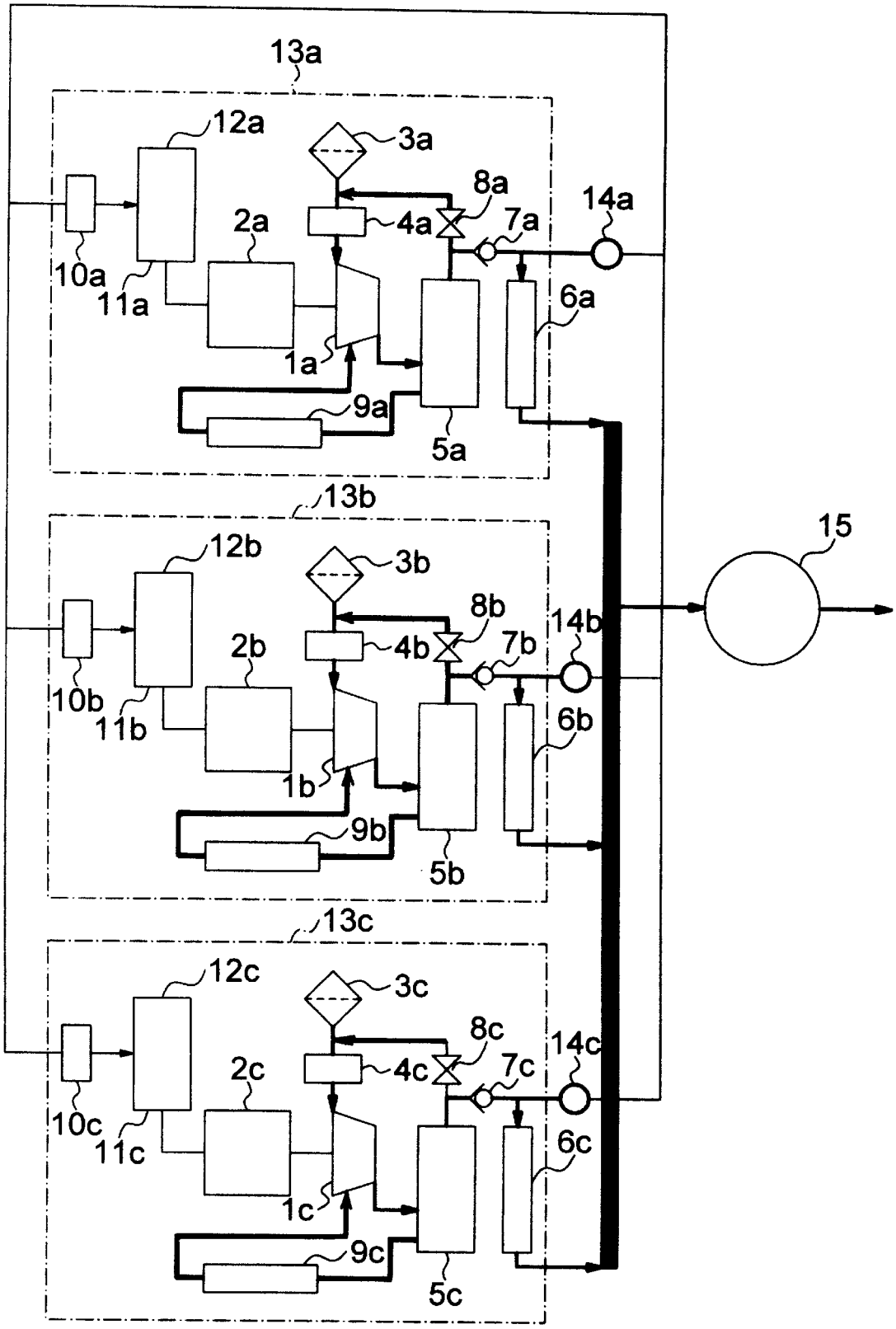
FIG. 1 is a systematic view illustrating an embodiment the compressed air production facility according to the present invention.
Figure 2:
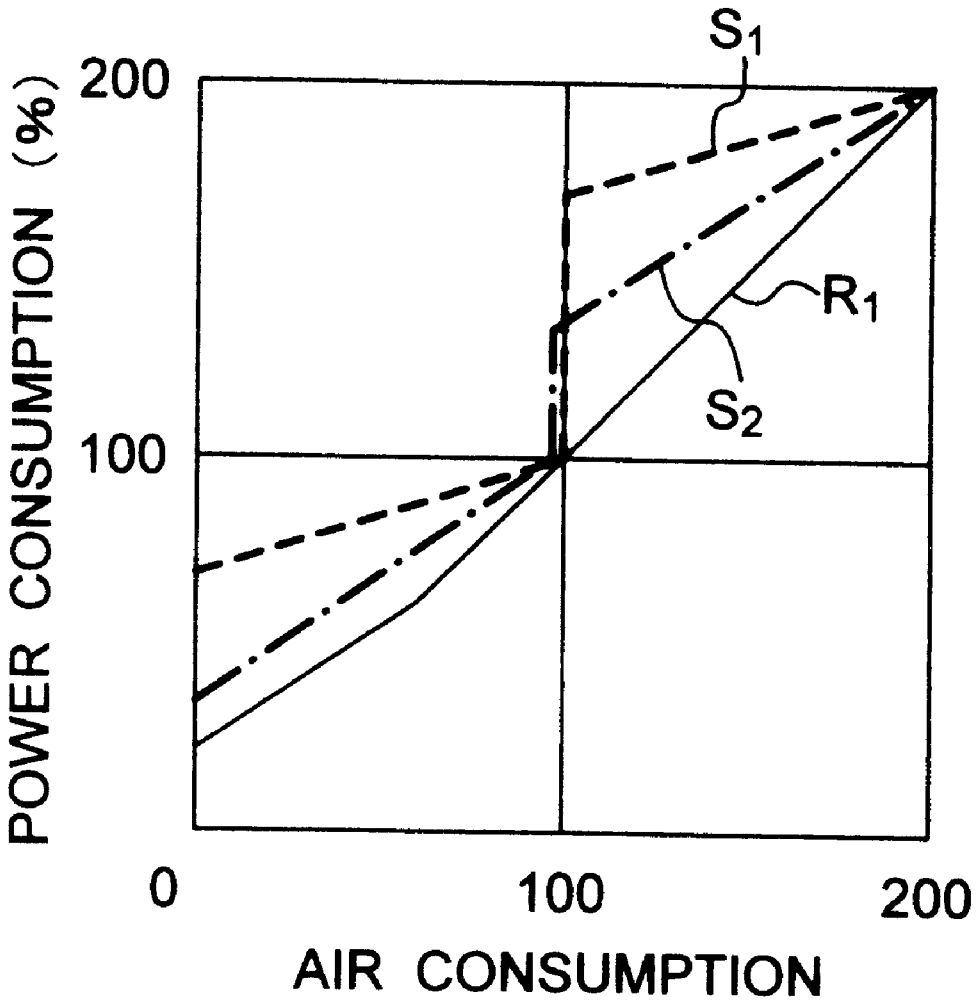
FIG. 2 PRIOR ART
FIG. 2 is a view for explaining power consumption of a compressed air production facility in which two compressors are operated in combination in a conventional manner.

FIG. 1 is a systematic view illustrating an embodiment of the compressed air production facility according to the present invention. In this embodiment, three compressors 13*a*, 13*b*, 13*c* are used to compress air.

A variable speed compressor 13*a* has a variable speed drive device 11*a*, such as an inverter, and a control device 10*a* for carrying out PID control of the drive device 11*a*. Further, through the PID control, the discharge pressure is controlled to be constant. Specifically, the frequency of a power source 12*a* for a motor 2*a*, is changed so as to change the speed of the motor 2*a* in order to change the speed of a compressor body 1*a*.

When the compressor body 1*a* is driven, the atmospheric air is led into the compressor body 1*a* by way of a suction filter 3*a* and a suction throttle valve 4*a*, is then compressed in the compressor body 1*a*, and is then led into an oil separator 5*a*. The compressed air from which oil components are removed in the oil separator 5*a*, flows into an after-cooler 6*a* by way of a check-valve 7 so as to be cooled therein, and thereafter, flows into an air reservoir 15. The oil removed from the compressed air in the oil separator 5*a* is cooled by the oil cooler 9*a*, and is then returned so as to be injected into the compressor body 1*a* for lubricating several parts of the compressor body 1*a* while cooling the compressed air.

The speed of the compressor body 1*a* is controlled in accordance with outputs from pressure sensors 14*a*, 14*b*, 14*c* provided downstream of check valves 7*a*, 7*b*, 7*c* so as to obtain a desired pressure which has been previously set. For example, if the discharge pressure of the compressed air production facility is raised as the consumed air volume is decreased, the speed of the motor 2*a* is decreased in response to this variation in the pressure, and accordingly, the air volume discharged from the compressor body 1*a* is decreased. As a result, the discharge pressure is controlled to a desired pressure. However, should the speed of the motor be lowered extremely, the efficiency of the compressor body 1*a* would excessively lowered, or the motor would not sufficiently be cooled. Accordingly, a speed which is about 30 15 to 30% of the maximum speed of the motor is usually set to a lower limit speed. For a load which is lower than that corresponding to the lower limit value, the volume of the compressed air is regulated by repeating both load operation at a lower limit speed, that is, the load operation at the lower limit speed and unload operation at a lower limit speed, in which the suction throttle valve 4*a* is closed while an air discharge valve 8*a* is opened. This method is detailed in Japanese Laid-Open Patent No. H7-293477, that is, when the pressure becomes higher than the desired value, the unload operation is carried out, and when the pressure is lowered down to the desired pressure, the load operation is started.

Another method of controlling the air volume during low load operation is disclosed in Japanese Laid-Open Patent No. S55-164792. In this method, the suction throttle valve 4*a* is continuously throttled. In another method, a vent valve 8*a* is opened without closing the suction throttle valve 4*a* so as to lower the pressure in the oil separator. In this embodiment, any of these method may be used.

At first, explanation will be hereinbelow made of the principle of the present invention, with the use of an example in which the single variable speed compressor and the single constant speed compressor are alone operated. Specifically, a constant speed compressor 13*b* is operated at a constant speed but the constant speed compressor 13*c* is rested. The flow of the working pressure and the flow of oil used as lubricant in the constant speed compressor 13*b* are the same as those in the variable speed compressor 13*a*, and accordingly, the details thereof will be omitted. The air discharged from an after cooler 6*b* merges into compressed air discharged from the variable speed compressor 13*a* in the air reservoir 15. The constant speed compressor 13*b* is different from the variable speed compressor 13*a* in view of such a fact that it is operated at a constant speed after it is started through the intermediary of a starter panel 11*b*. In order to operate the constant speed compressor 13*b* at a constant speed, unload operation in which a suction throttle valve 4*b* is closed in accordance with an output from the pressure sensors 14*a*, 14*b*, 14*c* while the air vent valve 8*b* is opened, and load operation are repeated so as to carry out capacitive control of the compressed air production facility.

A control device 10*b* for the constant speed compressor is provided therein with a stopping means adapted to open a contactor, for stopping the operation of the motor 2*b* if the unload operation is continued by a time exceeding a predetermined time, or if the pressure in the air reservoir exceeds a predetermined value or if pressures downstream of check valves 7*a*, 7*b*, 7*c* (that is, the discharge pressure of the compressed air production facility), detected by the pressure sensors 14*a*, 14*b*, 14*c* at predetermined time intervals satisfy a predetermined condition so as to energize the control device 10*b*. When the pressure sensors 14*a*, 14*b*, 14*c* detect such a case that the pressures downstream of the check valves are lowered down to a predetermined pressure, the stopping means in the starter panel 11*b* reenergizes the contactor so as to restart the motor 2*b*. It is noted that a method in which the suction throttle valve 4*b* is continuously throttled or the like may be used in addition to the above-mentioned method in which the load operation and the unload operation are repeated.

In this embodiment, the air reservoir 15 is provided, but this reservoir 15 is not indispensable, that is, the compressed air discharged from the compressors may be introduced into a common pipe line from which the compressed air is directly consumed. Further, the discharge pressure of the compressed air production facility may be represented by one of the discharge pressures from the incorporated compressors or an averaged value of these discharge pressures.

Further, although the plurality of pressure sensors are provided downstream of the check valves and connected to a common pipe line so as to control the two compressor in the above-mentioned embodiment, a common pressure sensor may be connected to the air reservoir, instead of the plurality of pressure sensors.

By the way, according to the present invention, pressures used for the control of the compressors have a relationship exhibited by the following formula:

$$PUb > P2 > P1 > Plb \quad (1)$$

where P1 is a desired pressure for controlling the speed of the variable speed compressor, P2 is an unload pressure of the variable speed compressor, PUb is an unload operation pressure or a rest pressure of the constant speed compressor 13*b* and PLb is a load operation pressure or a starting pressure. This relationship may be set for each of the compressors, or the pressure of one of the compressors is set while the pressure of the other one of the compressors is automatically set by the control devices 10*a*, 10*b*.

Figure 3:
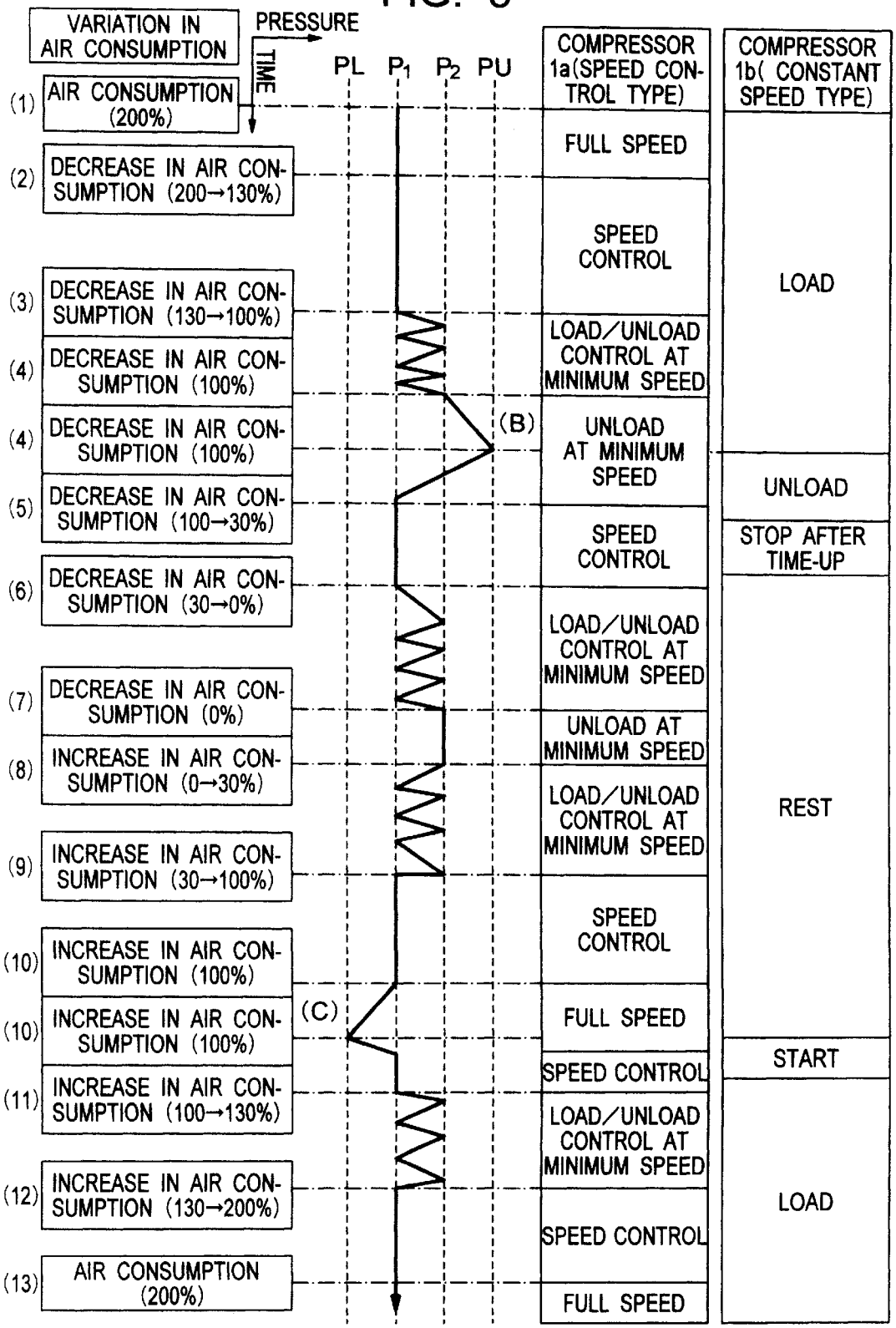
FIG. 3 is a pressure time chart relating to the embodiment of the compressed air production facility shown in FIG. 1.

Next, explanation will be made of operation of various components in this embodiment with reference to FIG. 3 in which the time progress is taken along the ordinate while the discharge pressure of the facility is taken along the abscissa, and in which respective operations of the variable speed compressor 13*a* and the constant speed compressor 13*b* when the air consumption changing are shown. It is noted here that the variable speed compressor 1*a* is adapted to repeat its load operation and unload operation if the air consumption is less than 30%.

When the air consumption comes up to an upper limited value (200%) which can be attained by the two compressors at maximum, the variable speed compressor 13*a* is operated at its full speed while the constant speed compressor 13*b* is operated in the load operation mode (Step 1).

During a period in which the air consumption is decreased from 200 to 130%, the speed of the variable speed compressor 13*a* is controlled so that the discharge pressure of the compressed air production facility becomes the desired pressure P1. During this period, the constant speed compressor 13*b* is operated in the load operation mode (Step 2).

When the air consumption is decreased down to a value blow 130%, the speed of the variable speed compressor 13*a* is decreased to its lower limit value, and accordingly, the discharge air volume can not be any more decreased by lowering the speed of the variable speed compressor 13*b*. As a result, the discharge pressure of the compressed air production facility becomes higher. The discharge pressure of the compressed air production facility is raised up to the pressure p2, the variable speed compressor 13*a* is operated in its unload operation mode. At this time, the volume of the discharge air is zero. When the variable speed compressor 13*a* falls in the unload operation mode, the discharge pressure of the compressed air production facility is lowered. When the discharge pressure of the compressed air production facility is lowered down to P1, the variable speed compressor is again operated at a lower limit speed, that is, the load operation is effected. In the range of 200 to 130% of the air consumption, the above-mentioned operation is repeated so as to regulate the volume of the discharge air. In this operation period, the constant speed compressor 13*b* continues its load operation (Step 3).

When the air consumption is decreased down to 100%, the variable speed compressor 13*a* is operated at the lower limit value in the unload operation mode. When the air consumption is decreased further, both compressors can not be any more decreased their volumes of discharge air, and accordingly, the discharge pressure of the compressed air production facility becomes higher, again (Step 4).

When the discharge pressure of the compressed air production facility is increased up to PUb, the constant speed compressor 13*b* falls in its unload operation mode. Thus, the volumes of discharge air from both compressors become zero. As a result, the pressure becomes lower at this time. When the discharge pressure of the compressed air production facility is lowered down to P1, the unload operation mode of the variable speed compressor 13*a* is released, and accordingly, the variable speed compressor is operated under speed control. Accordingly, the lowering of the pressure is stopped, and therefore, discharge pressure of the compressed air production facility is held at the desired pressure P1 through the operation of the variable speed compressor under speed control. Meanwhile, the constant speed compressor is still held in the unload operation mode. Further, a previously set time Tb on a timer elapses, the constant speed compressor 13*b* is rested (Step 5).

Further, if the air consumption is in the decreased range from 100 to 130%, the variable speed compressor 13*a* is operated under speed control so as to maintain the discharge pressure at P1. When the air consumption is decreased down to a value in a range from 30 to 0%, the variable speed compressor 13*a* again repeats its load operation and its unload operation at a lower limit speed, and accordingly, the discharge pressure of the compressed air production facility is held at a value between P1 and P2 (Step 6). When the air consumption is decreased down to 0%, the variable speed compressor 13*a* continues its unload operation at the lower limit speed (Step 7). The above-mentioned steps 1 to 7 carries out the operation pattern in which the air consumption is decreased from 200 to 0%.

By the way, a timer may be provided also to the variable speed compressor 13*a*. This timer is for automatically stopping the operation when the unload operation is continued. In this case, a set time Ta on the timer for the variable speed compressor 13*a* is set to be longer than the set time Tb on the timer for the constant speed compressor 13*b*. Accordingly, when the air consumption is decreased to 0%, the variable speed compressor can be stopped automatically.

Next, explanation will be made of a pattern in which the air consumption is increased from 0 to 100%. When the air consumption is increased from 0 to 100%, the variable speed compressor 13*a* is operated in the sequence reverse to that in the above-mentioned operation pattern which is carried out when the air consumption is decreased (Steps 8 and 9). If the air consumption is increased up to a value exceeding 100%, the desired pressure P1 cannot be maintained by the variable speed compressor 13*a* even though the variable speed compressor is operated with full speed, since the air consumption cannot be overcome by the variable speed compressor 13*a*. As a result, the discharge pressure of the compressed air production facility is gradually lowered.

When the discharge pressure of the compressed air production facility is lowered down to PLb, the constant speed compressor 13*b* is started, and the constant speed compressor 13 thus started carries out its load operation. Through this load operation of the constant speed compressor 13*b*, the discharge pressure of the compressed air production facility is increased. When this pressure is increased up to P1, the variable speed compressor 13*a* is operated under speed control so as to regulate the discharge air volume. When the discharge pressure of the compressed air production facility is further increased up to P2, the variable speed compressor 13*a* repeats its load operation and unload operation at its minimum speed. During this period, the constant speed compressor 13*b* having been restarted, continues its load operation (Steps 10, 11).

Further, when the air consumption is increased up to a value higher than 130%, the variable speed compressor 13*a* is again operated in the speed control mode (Step 12), and the variable speed compressor 13*a* is operated with full speed when the air consumption becomes 200%. The constant speed compressor 13*b* is still maintained in its load operation.

As mentioned above, in the compressed air production facility in this embodiment, the variable speed compressor 13*a* which is operated under speed control, is used to regulate the discharge air volume, and accordingly, ideal capacity control can be achieved. That is, since the power consumption varies substantially in proportion to an air consumption, it is possible to save consumption power. In the above-mentioned embodiment, although a relationship exhibited by the above-mentioned formula (1) is previously set, instead of setting the above-mentioned relationship, an optimum pressure may be automatically set. This setting can be made with no errors even by those unskilled in the art of compressors, and with the advantage of power saving. This method may be effective in such a case that the constant speed compressor have been operated before the variable speed compressor 13*a* is installed, and the pressure setting is unclear. An example of this setting will be hereinbelow explained. A valve having an adjustable opening degree is provided in a pipe line through which air is discharged from the air reservoir 15. Upon automatic setting, the valve is gradually closed or gradually opened. Accordingly, such a phenomenon that the air consumption is decreased or increased can be obtained. In this arrangement, a storage means for storing a time history of a pressure signal delivered from the pressure sensors 14*a* or 14*b* is provided to either the control device 10*a* for the variable speed compressor 13*a* or the control device 10*b* for the constant speed compressor 13*b*.

At first, when the valve provided in the air pipe is gradually closed, the discharge pressure of the compressed air production facility is increased. In a range in which the pressure of the air reservoir can be controlled to a predetermined pressure by changing the speed of the variable speed compressor 13*a*, the pressure is not changed noticeably. However, out of the speed control range of the variable speed compressor 13*a*, the pressure is increased. If the variable speed compressor 13 can be operated in its load operation mode and unload operation mode at its lower limit speed, the pressure in the air reservoir is increased and decreased in that range. Further, this pressure is that which have previously been set to the variable speed compressor 13*a*, and accordingly, if the pressure in the air reservoir is turned from its increasing direction into its decreasing direction at a pressure value different from this set pressure, the pressure value represents an unload operation pressure or a rest pressure of the constant speed compressor 13*b* which is arranged in parallel with the variable speed compressor 13*a*. This operation point corresponds to B in FIG. 3.

Similarly, the valve in the pipe line is gradually opened, the discharge pressure of the compressed air production facility is lowered. In the range in which the speed of the variable speed compressor 13*a* can be controlled, the pressure is not lowered noticeably, but if it is out of the speed control range, the discharge pressure of the compressed air production facility is lowered. The pressures with which the variable speed compressor 13*a* is operated in its unload operation mode or its load operation mode, have been previously set to the variable speed compressor 13*a*. Accordingly, if the pressure is turned from the decreasing direction into the increasing direction at a point other than these pressures, the pressure at this point represents its load operation pressure or start pressure of the constant speed compressor 13*b* which is arranged in parallel with the variable speed compressor 13*b*. This operation point corresponds to C in FIG. 3.

This pressure is stored or displayed in or on either of the control devices 10*a*, 10*b*. Further, a desired pressure, an unload operation pressure and the like of the variable speed compressor 13*a* are stored in the control device. In this arrangement, these values are inputted so as to satisfy the formula (1), and alternatively, a program for automatically obtaining values which can satisfy the formula (1) may be stored in the control device. As far as the relationship exhibited by the formula (1) is satisfied, the same effect can be obtained by changing even either the setting of the variable speed compressor 13*a* or the setting of the constant speed compressor 13*b*. It is noted that although the set values of the above-mentioned pressures are stored in the control device 10*a* or 10*b* in this embodiment, these values may be stored in another control device.

Next, explanation will be made of a specific example in which a plurality of constant speed compressors are operated, with reference to FIGS. 1 to 3 and 6. More specifically, the case of operating the constant speed compressors 13*b*, 13*c* will be explained.

Each of all compressors has an output power of 37 kW, and the volume of the air reservoir is 1.24 $m^3$. The compressors are all operated in an unload operation mode with the use of a suction throttle valve. The so-called U-type unload operation is such an unload operation that the opening degree of the suction throttle valve is continuously decreased while the so-called I type unload operation is such an unload operation that the suction throttle valve is closed, and simultaneously, the pressure on the upstream side of the check valve is decreased so as to lower the discharge pressure of the compressor, and the so-called load operation is other than the above-mentioned unload operations.

The speed of the variable speed compressor 13*a* is changed so as to set the discharge pressure of the compressor to a control pressure P1 of 0.62 MPa. The start pressure P2 of the I-type unload operation in which the discharge pressure of the variable speed compressor 13*a* is decreased simultaneously with the closing of the suction throttle valve is closed while the lower limit speed of the variable speed compressor is maintained, is set to 0.65 MPa. It is noted that the pressure P1' at which the compressor is returned from the I-type unload operation is set to 0.62 MPa.

Further, the control pressure PUb at which the constant speed compressor 13*b* starts its I-type unload operation is set to 0.69 MPa, and a pressure PLb at which the compressor is returned from the I-type unload operation, that is, the automatic restart pressure is set to 0.60 MPa while the pressure of starting the U-type unload operation is set to 0.69 MPa. Similarly, the pressure PUc at which the constant speed compressor starts its I-type unload operation is set to 0.67 MPa while the pressure PLc at which it is returned from the I-type unload operation, that is, the automatic start pressure is set to 0.58 MPa, and the pressure at which the U-type unload operation is started is set to 0.69 MPa.

As to the above-mentioned settings, the return pressure or the automatic restart pressure PLc of the constant speed compressor 13*c* may be substituted for the return pressure or the automatic restart pressure PLb of the constant speed compressor 13*b*.

Figure 4:
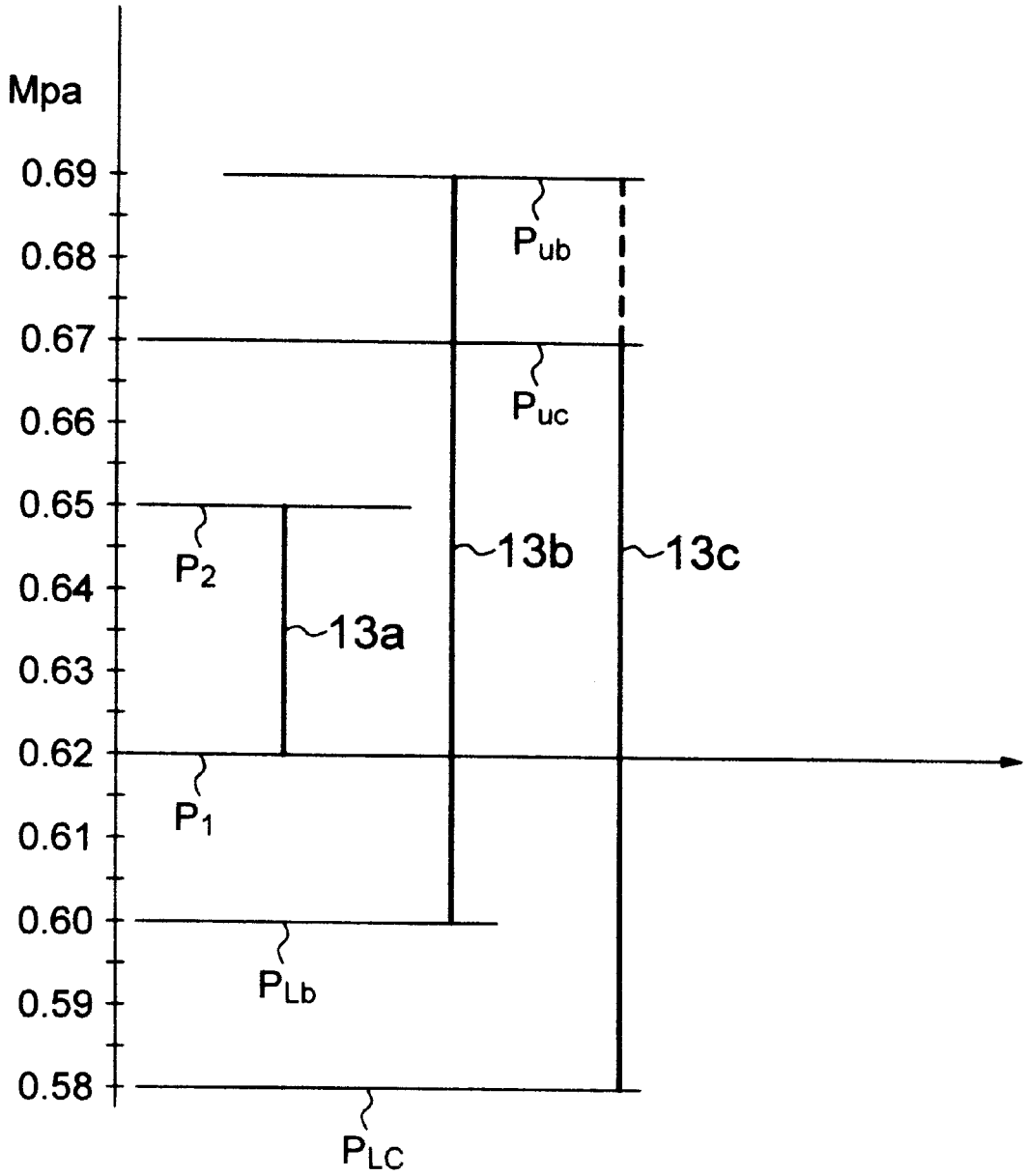
FIG. 4 is a view for explaining relations among the compressors in another embodiment of the present invention.

FIG. 4 shows the relationships among the set values of the pressures. In the constant speed compressor 13*b*, although the start pressure of the I-type unload operation is set so as to be equal to that of the U-type unload operation, the I-type unload operation is at first carried out at all.

Figure 5:
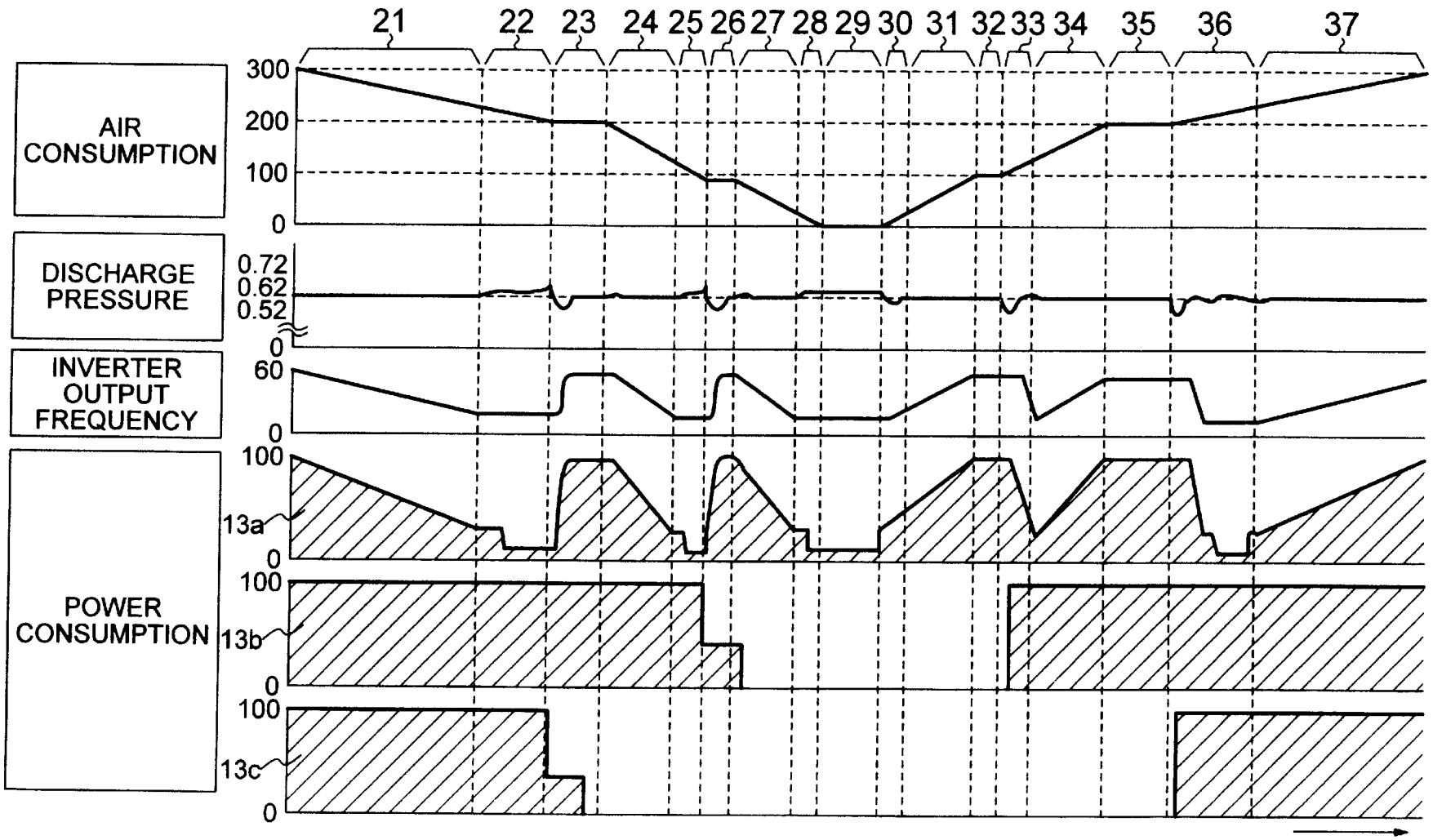
FIG. 5 is a control time chart relating to the compressed air production facility shown in FIG. 1, as an example.

FIG. 5 shows the timing chart of the operation of the compressed air production facility for which the operation pressures of the compressors are set as mentioned above. Since the maximum discharge air volume of each of the compressors is exhibited by 100%, the maxim discharge air volume 300% can be obtained in total from the three compressors. FIG. 5 also shows variations in the discharge pressure of the compressed air production facility, in the inverter output frequency and the power consumption of the variable speed compressor 13*a* and in the power consumption of the constant speed compressors 13*c*, 13*c* when the air consumption is changed from the maximum air consumption of 300% to 0% at which no air is consumed, or on the contrary, when the air consumption is changed from 0% to 300%.

The operation is started in such a condition that any of the variable speed compressor 13*a* and the constant speed compressors 13*b*, 13*c* is operated with output power of 100%, and the discharge pressure of the compressed air production facility, that is, the secondary pressure of the check valve 7*a* is set to 0.62 MPa.

The air consumption is changed from the 300 to 230% while discharge pressure $P_0$ is held at 0.62 Mpa (Step 21). At this time, the speed of the variable speed compressor 13*a* is lowered so as to prevent the discharge pressure $P_0$ from exceeding the control pressure P1 of 0.62 MPa, and accordingly, the pressure is maintained at a substantially constant value while the power consumption is lowered. Meanwhile, since the discharge pressure $P_0$ (0.62 MPa) is lower than the control pressure PUb (0.69 Mpa) of the constant speed compressor 13*b*, and the control pressure PUc (0.67 MPa)of the constant speed compressor 13*c*, the load operation is effected. Further, the discharge volume of the compressed air and the power consumption become 100%, respectively.

The constant speed compressors 13*b*, 13*c* exhibit characteristic as mentioned above, the lower the discharge volume of compressed air, the greater the rate of the power consumption. Meanwhile, the rate of the power consumption of the variable speed compressor 13*a* is not changed substantially even though the rate of the discharge air volume is changed. In this embodiment, the two constant speed compressors 13*b*, 13*c* is operated with their discharge volumes of compressed air and their electric power consumptions being respectively set to 100% while the rate of the power consumption is set be low so that variation in the discharge air volume of the compressed air production facility is burdened upon the variable speed compressor 13*a*, accordingly, it is possible to effect electric power saving.

The air consumption is lowered from a condition in which the power consumption is 230% while the discharge pressure $P_0$ is 0.62 MPa, the air consumption rate is changed to 200% (Step 22). The variable speed compressor 13*a* has already come down to its lower limit value, and accordingly, it can not lower its discharge air volume any more. When the air consumption is lowered, the discharge pressure $P_0$ is gradually raised. When the discharge pressure $P_0$ is raised up to the control pressure P2 (0.65 MPa), the variable speed compressor is operated in the I-type unload operation mode. However, the discharge pressure is still lower than the control pressures PUb, PUc of the constant speed compressors 13*b*, 13*c*, the load operation is continued. The discharge volume of the compressed air and the power consumption are 100%, respectively.

When the air consumption becomes lower than 200%, the discharge pressure $P_0$ is gradually increased (step 23) since the constant speed compressors 13*b*, 13*c* are both operated in such a condition that their discharge volumes of the compressed air are both 100%, respectively. When the discharge pressure is raised exceeding the control pressure PUb of 0.67 MPa, the constant speed compressor 13*c* is turned into the I-type unload operation mode. If the discharge pressure $P_0$ is lowered down to the control pressure PLc of 0.58 MPa within 3 minutes after the unload operation is started, the constant speed compressor 13*c* is turned into the load operation mode from the I-type unload operation mode.

However, at step 23, since more than 3 minutes has elapsed until the discharge pressure becomes higher than the control pressure PLc of 0.58 MPa from the time when the operation is turned into the I-type operation mode, the constant speed compressor is rested, automatically. Since the constant speed compressor 13*c* has stopped, the discharge volume of the compressed air production facility can be obtained only by that of the constant speed compressor 13*b*, and accordingly, the air consumption is insufficient by 100% at maximum. As a result, the discharge pressure $P_0$ is lowered.

The discharge pressure $P_0$ is lowered down to the control pressure P1 of 0.62 MPa, the variable speed compressor 13*a* is turned from the I-type unload operation into the load operation mode in which the speed thereof is controlled. Further, the speed is increased so that the compressed air is produced making up for the shortage. When it has made up for the shortage, the discharge pressure $P_0$ is again increased up to the control pressure (P1) of 0.62 MPa.

Since the discharge pressure $P_0$ is not lowered down to the return pressure PLc of 0.65 MPa for the constant speed compressor 13*c*, the constant speed compressor 13*c* is not turned into the load operation mode. Accordingly, it comes to a stop by way of the I-type unload mode. Further, the discharge pressure $P_0$ is not increased to the control pressure (PUb) of 0.69 MPa, the constant speed compressor continues the load operation.

The air consumption is changed from 200% to 130% (Step 24). Accordingly, the speed of the constant speed compressor 13*a* is lowered, and accordingly, the discharge pressure $P_0$ is maintained at the control pressure P1 of 0.62 MPa. Since the discharge pressure $P_0$ does not reach the control pressure PUb of 0.6 MPa, the constant speed compressor 13*b* continues the load operation.

The air consumption is changed from 130% to 100% while the discharge pressure is maintained at the control pressure P1 of 0.62 MPa (Step 25). Since the speed of the variable speed compressor has already reached the lower limit speed, the discharge air volume is not decreased further. When the air consumption is lowered, the discharge pressure $P_0$ is increased, gradually. When the discharge pressure $P_0$ is increased up to the control pressure P2 of 0.65 MPa, the variable speed compressor 13*a* is turned into the I-type unload operation mode. Further, since the discharge pressure $P_0$ is lower than the control pressure Pub of 0.69 MPa, the constant speed compressor 13*b* continues its load operation. At this step 25, only the constant speed compressor 13*b* produces compressed air.

Since the discharge volume of the compressed air of the constant speed compressor 13*b* is 100%, if the air consumption becomes lower than 1000%, the discharge pressure $P_0$ is increased gradually (Step 26). If the discharge pressure $P_0$ exceeds 0.62 MPa, it is higher than the control pressure Pub of the constant speed compressor 13*b*, and accordingly, the constant speed compressor 13*b* is turned into the I-type unload operation mode.

When the discharge volume of the compressed air is decreased to 0% after the constant speed compressor 13*b* is turned into the I-type unload operation mode, the discharge volume of the compressed air becomes insufficient since the air consumption is not 0%. As a result, the discharge pressure $P_0$ is gradually lowered. When the discharge pressure $P_0$ is lowered from the control pressure PUb of 0.69 MPa to the control pressure Pa of 0.62 MPa of the variable speed compressor 13*a*, the variable speed compressor 13*a* is turned from the I-type unload operation into the load operation in which the speed thereof is controlled. Further, the speed of the variable speed compressor 13*a* is increased until the discharge pressure $P_0$ is raised up to the control pressure Pa of 0.62 MPa, and accordingly, the shortage of the air volume is made up for. After the shortage is made up for, the discharge pressure $P_0$ is increased up to the control pressure Pa of 0.62 MPa, and is then maintained at this value. The discharge pressure $P_0$ is not lowered down to the return pressure Plb of the constant speed compressor 13*b*. As a result, the constant speed compressor 13*b* is not turned into the load operation mode but it continues the I-type unload operation.

The air consumption ratio is changed from 100 to 30% when the discharge pressure is the control pressure P1 of 0.62 MPa (Step 27). The speed of the variable speed compressor 13*a* is decreased. The constant speed compressor 13*b* is turned into the I-type unload operation mode, and since such a condition that the discharge pressure $P_0$ is higher than the return pressure is continued by a time which is longer than 3 minutes, the constant speed compressor 13*b* is automatically stopped from the I-type unload operation mode.

The air consumption rate is changed from 30 to 0% when the discharge pressure $P_0$ is the control pressure P1 of 0.62 MPa (Step 28). Since the variable speed compressor 13*a* has been already operated at the lower limit speed, the discharge pressure $P_0$ is not lowered any more. Accordingly, the discharge pressure $P_0$ is gradually raised as the consumption is lowered. When the discharge pressure $P_0$ is raised up to the control pressure P2 of 0.65 MPa, the variable speed compressor 13*a* is turned into the I-load operation mode. Due to the unload operation of the variable speed compressor 13*a*, the compressed air is not supplied into the air reservoir 1. Subsequently, the discharge pressure $P_0$ is merely lowered but is never raised.

The variable speed compressor 13*a* continues its I-type operation until the discharge pressure $P_0$ is lowered down to the control pressure P1 of 0.62 MPa (Step 29). The description stated hereinabove concerns such a case that the air consumption is decreased. Next, explanation will be hereinbelow made of such a case that the air consumption is increased.

When the air consumption is increased from 0%, the discharge pressure $P_0$ is gradually lowered (Step 30). When the discharge pressure $P_0$ is lowered to a value lower than the control pressure P1 of 0.62 MPa, the variable speed compressor 13*a* is turned from the I-type unload operation mode into the speed control mode so that the operation of the variable speed compressor 13*a* at the lower limit speed is started. Incidentally, if the air consumption is lower than 30%, the speed of the variable speed compressor 13*a* is maintained at the lower limit speed.

When the air consumption is changed from 30 to 100%, the variable speed compressor 13*a* increases its speed from the lower limit speed to the maximum speed so as to maintain the discharge pressure $P_0$ at the control pressure P1 of 0.62 MPa while the discharge volume of the compressed air is increased up to 100% (Step 31).

The air consumption is maintained at 100% (Step 32). The variable speed compressor 13*a* continues its load operation while it maintains its maximum speed.

The air consumption is increased from 100 to 130% (Step 33). The discharge pressure $P_0$ is gradually lowered. When the discharge pressure $P_0$ is lowered down to the return pressure PLb of 0.60 MPa, the constant speed compressor 13*b* is automatically restarted so as to effect the load operation. Since the constant speed compressor 13*b* is operated in the load operation mode, the discharge volume of the compressed air is increased by 100%, and accordingly, the discharge pressure $P_0$ is raised. When the discharge pressure $P_0$ is increased exceeding the control pressure P2 of 0.62 MPa, the speed of the variable speed compressor 13*a* is lowered in order to restrain the discharge pressure $P_0$ from being further increased. Then, the discharge pressure $P_0$ is stabilized at the control pressure P1 of 0.62 MPa.

The air consumption is increased from 130 to 200% (Step 34). Since the discharge pressure $P_0$ is lowered from the control pressure P1 of 0.62 MPa, the speed of the variable speed compressor 13*a* is increased up to the maximum speed in order to compensate the discharge pressure $P_0$ for the lowering so as to stabilize the discharge pressure $P_0$ at the control pressure P1 of 0.62 MPa.

The air consumption is maintained at 200% (Step 35). The variable speed compressor 13*a* continues its load operation with the output power of 100% while the operation of the variable speed compressor 13*a* is maintained at the maximum speed. At this time, the constant speed compressor 13*b* also continues the load operation with the output power of 100%.

The air consumption 13*b* is changed from 200 to 230% (Step 36). Since the number of the compressors on operation is only two, the discharge volume of the compressed air becomes insufficient, and accordingly, the discharge pressure $P_0$ is gradually lowered. When the discharge pressure $P_0$ is lowered down to the return pressure PLc of 0.58 MPa, the constant speed compressor 13*c* is restarted automatically, and the load operation is effected. Since the constant speed compressor 13*c* carries out the load operation, the discharge volume of the compressed air is increased by 100%. As a result, the discharge volume of the compressed air exceeds the air consumption, and accordingly, the discharge pressure $P_0$ is raised. When the discharge pressure $P_0$ is raised up to the control pressure P1 of 0.62 MPa, the speed of the variable speed compressor 13*a* is decreased so as to control the discharge pressure $P_0$ to the control pressure P1 of 0.62 MPa. The discharge pressure $P_0$ is raised even though the speed of the variable speed compressor 13*a* is decreased down to the lower limit value, and when the discharge pressure $P_0$ exceeds the control pressure P2 of 0.65 MPa, the variable speed compressor 13*a* is turned into the I-type unload operation mode. At this step 36, since the air consumption is maintained to be higher than 200% but lower than 230%, the variable speed compressor 13*a* repeats the I-type unload operation and the load operation at the lower limit speed.

The air consumption is increased from 230 to 300% (Step 37). Since the discharge pressure $P_0$ is lowered from the control pressure P1 of 0.62 MPa, the speed of the variable speed compressor 13*a* is increased up to the maximum speed in order to maintain the discharge pressure $P_0$ at the control pressure P1 of 0.62 MPa.

During the procedure from Step 21 to Step 37, the constant speed compressors are turned into the unload operation at the time point of change-over of the control when the air use volume is lowered, but in the other conditions, the constant speed compressors are operated in either the load operation mode or the automatic rest condition. Accordingly, it can be understood that the variation in the air consumption is adjusted with the use of the discharge volume of the compressed air of the variable speed compressor 13*a*. Thus, the compressed air production facility is operated with electric power saving.

In this embodiment, the discharge pressure of the variable speed compressor 13*a* is detected on the secondary side of the check vale 7*a*, and the discharge pressures of the constant speed compressors 13*b*, 13*c* used for the control are also detected on the secondary side of the check valve 7*a*. Because the pressure differential between the secondary side pressure of the check valve 7*a* and the pressure in the air reservoir is changed as the speed of the variable speed compressor 13*a* is changed. If the discharge pressures of the compressors are detected at the secondary sides of the check valves provided in the discharge pipes from the compressors, the range between the upper and lower limit values of the pressure at which the load and unload operations are changed over, should be set to be wide in view of the differential pressures between the pressures at the positions of the detection and the pressure in the air reservoir. Further, if the pressures of the compressors are detected in the air reservoir, the distance between each of the compressors and the air reservoir becomes long, and accordingly, variation in the pressure is delayed. Thus, even though the use volume of the compressed air is constant, the speed of the variable speed compressor 13*a* is subjected to hunting, and accordingly, there is a fear of hunting of the pressure in the air reservoir. Thus, if a plurality of constant speed compressors and a variable speed compressors are controlled in combination, it is desirable to commonly use the secondary side pressure of the check value for the variable speed compressor.

Figure 6:
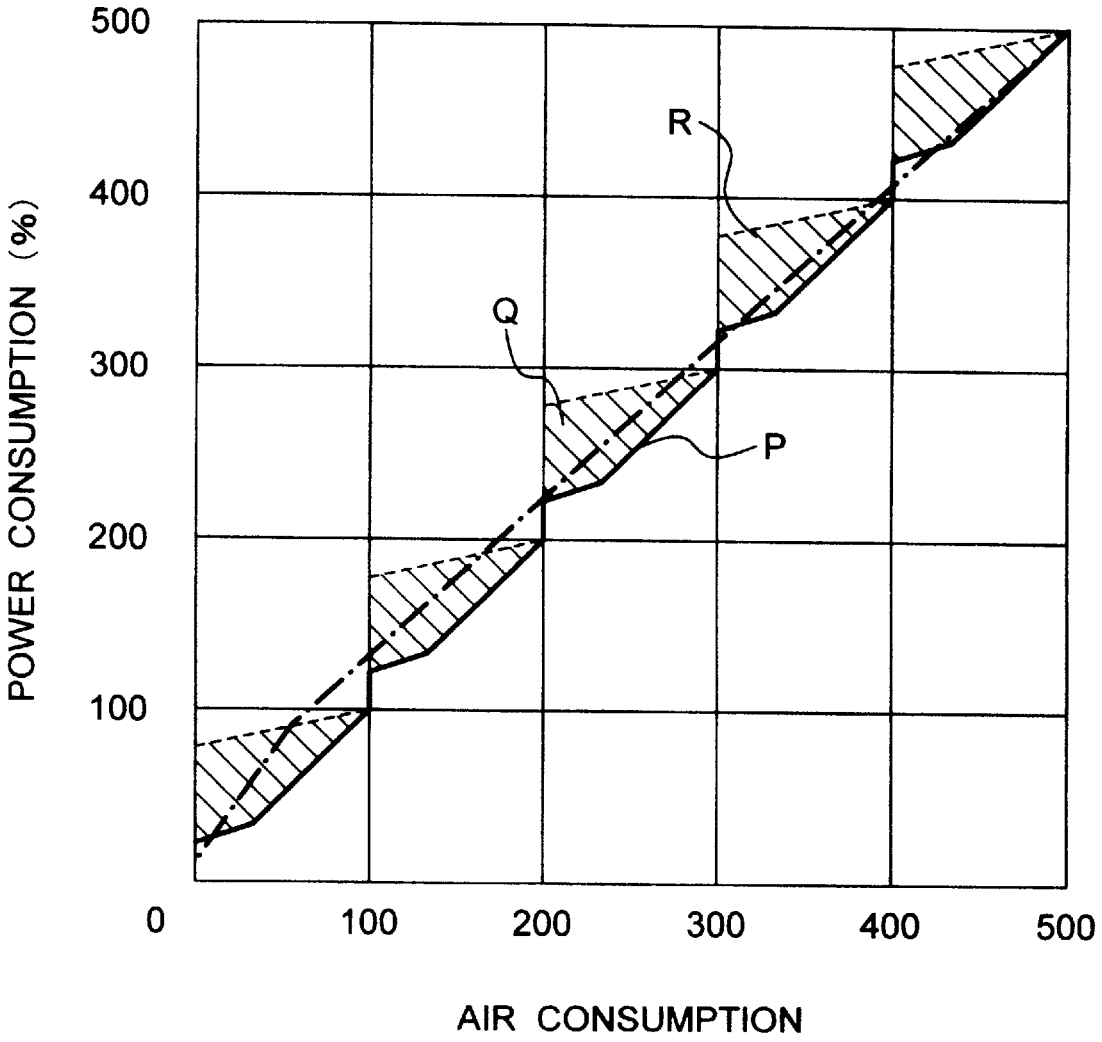
FIG. 6 is a view for explaining power consumption characteristics.

FIG. 6 shows such a situation that the power consumption is reduced according to the present invention in the case of four constant speed compressors are combined with a single variable speed compressor (curve P). For the purpose of comparison, such a case that five constant speed compressors are all capacitively controlled (curve Q), and such a case that five variable speed compressors are all capacitively controlled (curve R) are also shown. According to this embodiment, it is possible to obtain such an ideal characteristic that the power consumption is lowered substantially linearly with respect to the air consumption. Further, in this embodiment, in comparison with the capacitive control processes (curves Q, R) which have conventionally used, the electric power can be saved at every air consumption. Specifically, with the use of five compressors 5 each having a power consumption of 37 Kw, among which four compressors are constant speed type and one compressor is variable speed type, the electrical power can be saved by 18 kWh at maximum.

It is noted that a predetermined discharge pressure can be precisely maintained with the use of a variable speed compressor under control, and accordingly, the electric power consumption caused by useless pressure rise may be reduced if the set pressure is slightly higher than the automatic return pressure.

Further, in the above-mentioned embodiment, the I-type unload operation is carried out when the discharge pressure $P_0$ is raised during operation of the variable speed compressor at the lower limit speed. However, if the discharge pressure $P_0$ is still raised even at the lower limit speed, it may be shifted into the U-type unload operation mode.

Further, as the variable speed compressor 13*a*, a compressor which can be operated in both I-type unload operation mode and U-type operation mode may be used. In this case, the U-type unload operation is stared after the discharge pressure $P_0$ is increased up to a desired pressure, and if the discharge pressure $P_0$ exceeds a preset pressure when a predetermined time such as three minutes elapses after the U-type unload operation is initiated, the operation may be turned into the I-type operation mode from the U-type operation mode. Further, if the secondary pressure exceeds a preset value when a predetermined time such as three minutes elapses after the variable speed compressor 13*a* is turned into the I-type unload operation mode, any of the constant speed compressors on operation may be turned into the I-type operation mode.

Although it has been explained in the above-mentioned embodiment that the only a single variable speed compressor is used, a plurality of variable speed compressors may be used for the purpose of the stand-by operation for a failure. Further, the order of constant speed compressors for which the operation mode is changed over should not be fixed but they may be suitably changed in view of their operation times.

As stated hereinabove, according to the present invention, when the variation in air consumption is to be made up for with the use of a plurality of compressors, the compressors are capacitively controlled so as to linearly change the power consumption, thereby it is possible to reduce useless power consumption.

What is claimed is:

1. A compressed air production facility comprising at least one constant speed compressor which repeats load and unload operation at a predetermined speed under on-off control, a variable speed compressor driven by a motor incorporating an inverter, a common pipe line into which discharge air discharged from said constant speed compressor and discharge air discharged from said variable speed compressor are both led, a detecting means provided in said pipe line or air-reservoir, for detecting a pressure of the discharge air, and for controlling the discharged pressure to a predetermined set pressure with the use of said variable speed compressor, wherein the discharge pressure of said variable speed compressor on operation is controlled to said set pressure which falls between a discharge pressure of said constant speed compressor during said load operation and a discharge pressure of the constant speed compressor during the unload operation.

2. A compressed air production facility as set forth in claim 1, wherein said variable speed compressor is operated in the unload operation mode at a lower limit speed when the consumption of compressed air is decreased, and if said unload operation is continued for a predetermined time, the operation of said variable speed compressor is stopped.

3. A compressed air production facility as set forth in claim 1, wherein said variable speed compressor repeats the unload operation and the load operation at a lower limit speed when the consumption of compressed air is decreased, both discharge pressures during the load and unload operation of said variable speed compressor are controlled between the discharge pressure of the constant speed compressor during said load operation and the discharge pressure of said constant speed compressor during the unload operation.

4. A compressed air production facility as set forth in claim 1, wherein a plurality of constant speed compressors are connected in parallel with each other.

5. A compressed air production facility as set forth in claim 4, wherein a set pressure at which said variable speed compressor is turned from the load operation mode into the unload operation mode and a set pressure at which said variable speed compressor is turned from the unload operation mode into the load operation mode, are set between a set pressure at which all said constant speed compressors turned from the load operation mode into the unload operation mode and a set pressure at which all said constant speed compressors are turned from the unload operation mode into the load operation.

6. A compressed air production facility as set forth in claim 5, wherein the set pressure at which said constant speed compressors are turned from the load operation into the unload operation is different among the constant speed compressors, and the set pressure at which said constant speed compressors are turned from the unload operation into the load operation is different among the constant speed compressors.

7. A compressed air production facility as set forth in claim 1, further comprising an input means for inputting a set pressure of said compressed air production facility, and a setting means for setting a discharge pressure or a start pressure of said variable speed compressor during the load operation to a value lower than said set pressure of said compressed air production facility, and setting a discharge pressure or a rest pressure of said variable speed compressor during the unload operation to a value higher than the set value of the compressed air production facility.

8. A compressed air production facility as set forth in claim 1, further comprising an automatic setting means for automatically setting said set pressure between a discharge pressure or a start pressure of said variable speed compressor during load operation and a discharge pressure or a rest pressure of said variable speed compressor during the unload operation.

9. A compressed air production facility as set forth in claim 1, wherein said variable speed compressor and the constant speed compressor are provided respectively with automatic speed means for automatically stopping the compressors when the unload operation is continued for a time exceeding a predetermined unload time, and the unload set time of said variable speed compressor is longer than the unload set time of said constant speed compressor.

10. A compressed air production facility comprising at least one constant speed compressor which repeats load and unload operation at a predetermined speed under on-off control, a variable speed compressor driven by a motor incorporating an inverter, a common pipe line into which discharge air discharged from said constant speed compressor and discharge air discharged from said variable speed compressor are both led, and a control means for controlling a discharged pressure of a variable speed compressor to a predetermined set pressure with the use of said variable speed compressor so as to control the discharge pressure of said variable speed compressor to the set pressure which falls between a discharge pressure of said constant speed compressor during the load operation and a discharge pressure of said constant speed compressor during the unload operation, a detecting means for detecting the discharge pressure, a storage means for storing, as an unload operation pressure or a rest pressure of said constant speed compressor, a pressure at which the discharge pressure is turned from an increasing direction into a decreasing direction when air consumption being decreased, and for storing, as a load operation pressure or a start pressure of said constant speed compressor, a pressure at which the discharge pressure is turned from a decreasing direction into an increasing direction, and a means for setting the set pressure of said variable speed compressor to a value between said thus stored two pressures.

11. A compressed air production facility as set forth in claim 10, wherein a pressure detected by said detecting means is compared with the set pressure of said variable speed compressor, and accordingly, the unload operating pressure or rest pressure of said constant speed compressor is set to be higher than the set pressure of said variable speed compressor while the load operation pressure or start pressure of the constant speed compressor is set to be lower than the set pressure of the variable speed compressor.

12. A compressed air production facility, comprising a plurality of constant speed compressors which repeat load operation and unload operation under on-off control, a variable speed compressor driven by a motor incorporating an inverter, a common pipe line through which discharge air discharged from said compressors is led, and a control means for carrying out such a control that said plurality of constant speed compressors are operated in accordance with an air consumption so as to successively operate and stop said plurality of the constant speed compressor, and said variable speed compressor is always operated.

13. A compressed air production facility as set forth in claim 12, wherein the load operation starting pressure and the unload operation starting pressure of said variable speed compressor are both set between the load operation starting pressure and the unload operation staring pressure of said all constant speed compressors.

14. A compressed air production facility as set forth in claim 13, wherein said variable speed compressor has a suction throttle valve, and said control means changes over the operation between an operation mode in which the speed of said variable speed compressor is changed, and an I-type unload operation mode in which said suction throttle valve is used while the rotational speed of the motor is maintained at a lower limit speed of rotational speed control.

15. A compressed air production facility as set forth in claim 13, wherein said variable speed compressor has a suction throttle valve, and said control means changes over the operation between an operation mode in which the speed of said variable speed compressor is changed, and a U-type unload operation mode in which said suction throttle valve is used while the rotational speed of. the motor is maintained at a lower limit speed of rotational speed control.

16. A compressed air production facility as set forth in claim 13, wherein a first check valves and a first pressure detecting means in the vicinity of the first check valve, are provided downstream of at lease one of said plurality of constant speed compressors while a second check valve and a second pressure detecting means in the vicinity of the second check valve are provided downstream of said variable speed compressor, and said control means controls the operation of said all compressors in accordance with pressures detected by said first and second pressure detecting means.

* * * * *